United States Patent [19]

Luchonok

[11] Patent Number: 4,975,995

[45] Date of Patent: Dec. 11, 1990

[54] WATER MATTRESS WITH VERTICALLY DISPOSED DAMPENING CELLS

[75] Inventor: Jeffrey J. Luchonok, Torrance, Calif.

[73] Assignee: Advanced Sleep Products, Carson, Calif.

[21] Appl. No.: 405,450

[22] Filed: Sep. 11, 1989

[51] Int. Cl.[5] ..... A47C 27/08

[52] U.S. Cl. ..... 5/450; 5/451

[58] Field of Search ..... 5/451, 450, 452, 422, 5/441, 457

[56] References Cited

U.S. PATENT DOCUMENTS

| | | | |
|---|---|---|---|
| 4,208,748 | 6/1980 | Lobach | 5/451 |
| 4,329,748 | 5/1982 | Finkelstein | 5/451 |
| 4,459,714 | 7/1984 | Lin | 5/451 |
| 4,577,356 | 3/1986 | Johenning et al. | 5/451 |
| 4,663,789 | 5/1987 | Smith | 5/451 |
| 4,715,076 | 12/1987 | Fogel et al. | 5/451 |
| 4,751,757 | 6/1988 | Moreno | 5/451 |
| 4,864,670 | 9/1989 | Woll et al. | 5/450 |

FOREIGN PATENT DOCUMENTS

| | | | |
|---|---|---|---|
| 59123 | 9/1982 | European Pat. Off. | 5/451 |

*Primary Examiner*—Alexander Grosz

*Attorney, Agent, or Firm*—Kinzer, Plyer, Dorn, McEachran & Jambor

[57] ABSTRACT

A waterbed mattress has a baffle structure formed of a buoyant pad capable of floating freely within the mattress and a plurality of chambers attached to the pad. An upper portion of the chambers depend from the pad and are attached to the undersurface thereof. A lower portion of the chambers are attached to and depend from the upper chambers. There are openings connecting the upper and lower chambers from the passage of water therebetween when the weight of a person is placed upon the mattress. The pad and chambers have sufficient buoyancy that the baffle structure floats within the waterbed mattress.

7 Claims, 2 Drawing Sheets

WATER MATTRESS WITH VERTICALLY DISPOSED DAMPENING CELLS

SUMMARY OF THE INVENTION

The present invention relates to a waterbed mattress and in particular to a baffle structure for such a mattress, which baffle structure not only reduces wave motion but also slows or retards movement of the body into the mattress.

One purpose of the invention is to provide a baffle structure as described which is simple in construction, reliable, and which is formed of materials which may be reliably heat sealed together.

Another purpose of the invention is to provide a waterbed mattress baffle structure which includes a matrix of vertically aligned dampening chambers.

Another purpose of the invention is to provide a baffle structure which is formed of a plurality of individual chambers, each of which has interconnections thereon so that the chambers may be joined together as a unit.

Another purpose of the invention is to provide a waterbed mattress baffle structure formed of a buoyant pad and a matrix of vertically aligned dampening chambers connected thereto.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
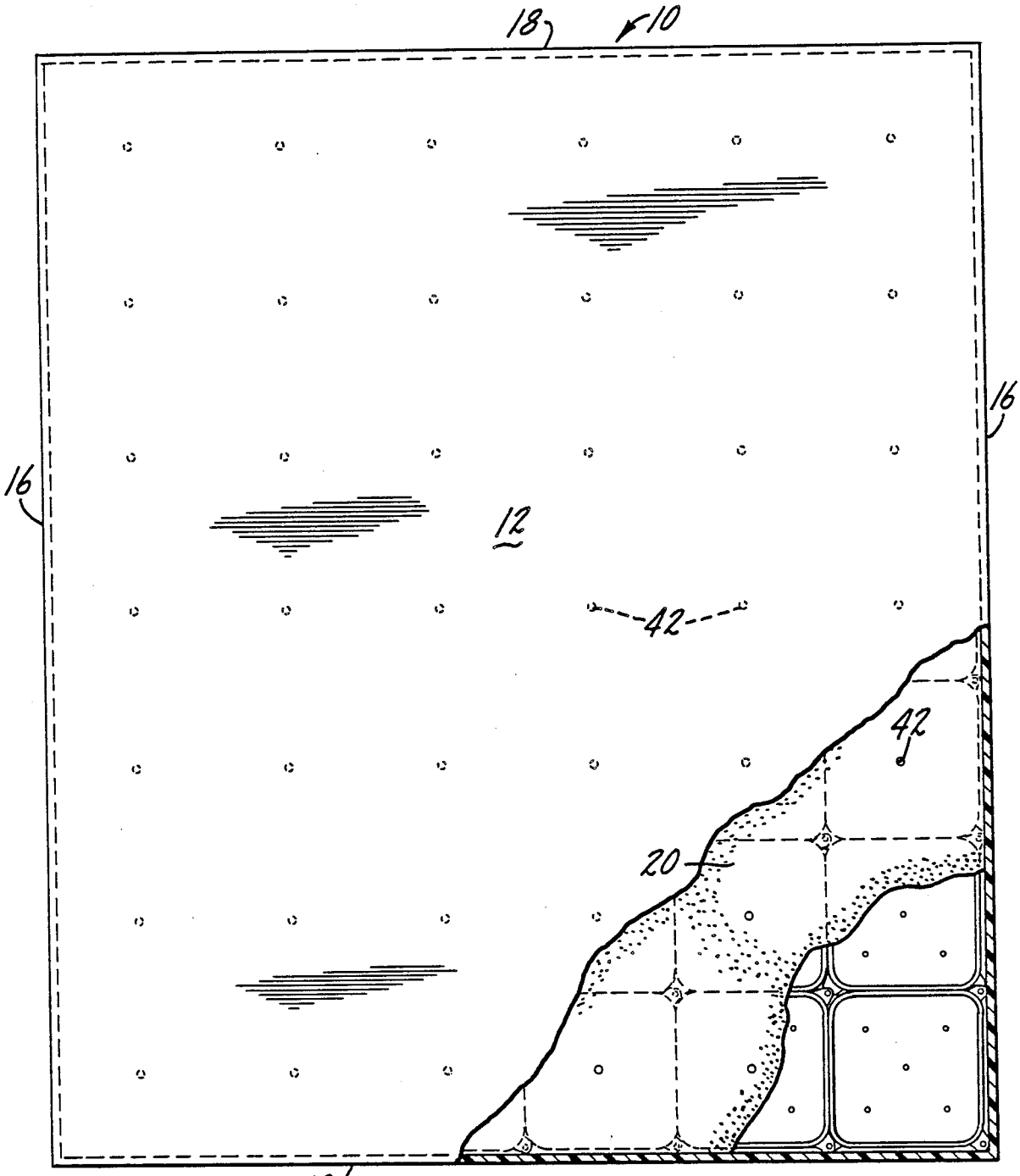
FIG. 1 is a top plan view of a waterbed mattress, with portions removed to disclose the interior baffle structure.
Figure 2:
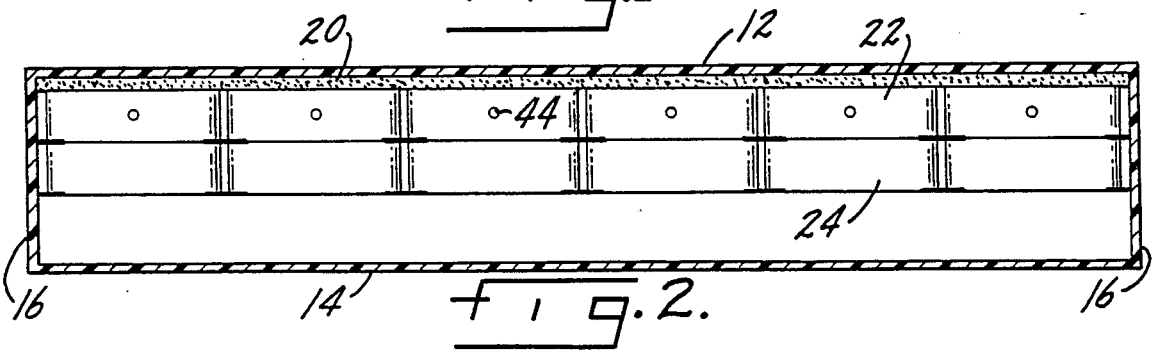
FIG. 2 is an end view of the mattress of FIG. 1, with the wall removed.

U.S. Pat. No. 4,577,356, owned by the assignee of the present application, shows a baffle structure for a waterbed mattress in which there is a pad of buoyant material formed preferably of polyethylene foam which is capable of floating freely within the mattress. Depending from the layer of foam are a plurality of chambers preferably formed, at least in part, of a polyethylene material denser than water. The chambers have water openings so that the baffle structure reduces wave motion within the mattress.

U.S. Pat. No. 4,627,121 discloses a waterbed mattress baffle construction characterized as a chamber within a chamber, which configuration is designed to reduce wave motion.

The present invention is best characterized as a waterbed mattress baffle using a chamber upon a chamber, with the baffle configuration not only reducing wave motion within the water mattress, but also providing a means to slow or retard or dampen the rate at which a person sinks into the mattress. The particular chamber upon a chamber disposition in the baffle provides for the transfer of water between vertically aligned chambers which slows the rate at which a person sinks into the mattress in that the weight of a person is absorbed by the water within the chambers, with the water slowly flowing outwardly from the chambers through the limited openings in the chamber walls. Also, water is transferred from the upper chambers to the lower chambers and then from the lower chambers out into the general area of the mattress, with the transfer of the water caused by the limited openings in the chambers, retarding the rate at which a person sinks into the mattress.

The water mattress is indicated generally at 10 and may have an exterior formed of a suitable flexible material such as vinyl. There is a top surface 12, a bottom 14, side walls 16 and end walls 18. There may be suitable heat sealed seams along the corners and along the joint between the walls and the bottom, as is conventional in most waterbed constructions. The material forming the waterbed mattress and the particular configuration of the surface of the top sheet of the mattress are not essential to the present invention.

Positioned within the mattress 10 is a baffle structure which includes a pad 20, preferably formed of a polyethylene foam, which has a density less than water such that the pad will be buoyant and float within the body of water within the mattress. Generally, foam pad 20 is coextensive with the top surface of the waterbed mattress. The pad may be a single section or it may be subdivided into two or more separate sections, the sections together being generally coextensive with the top surface of the mattress.

Figure 3:
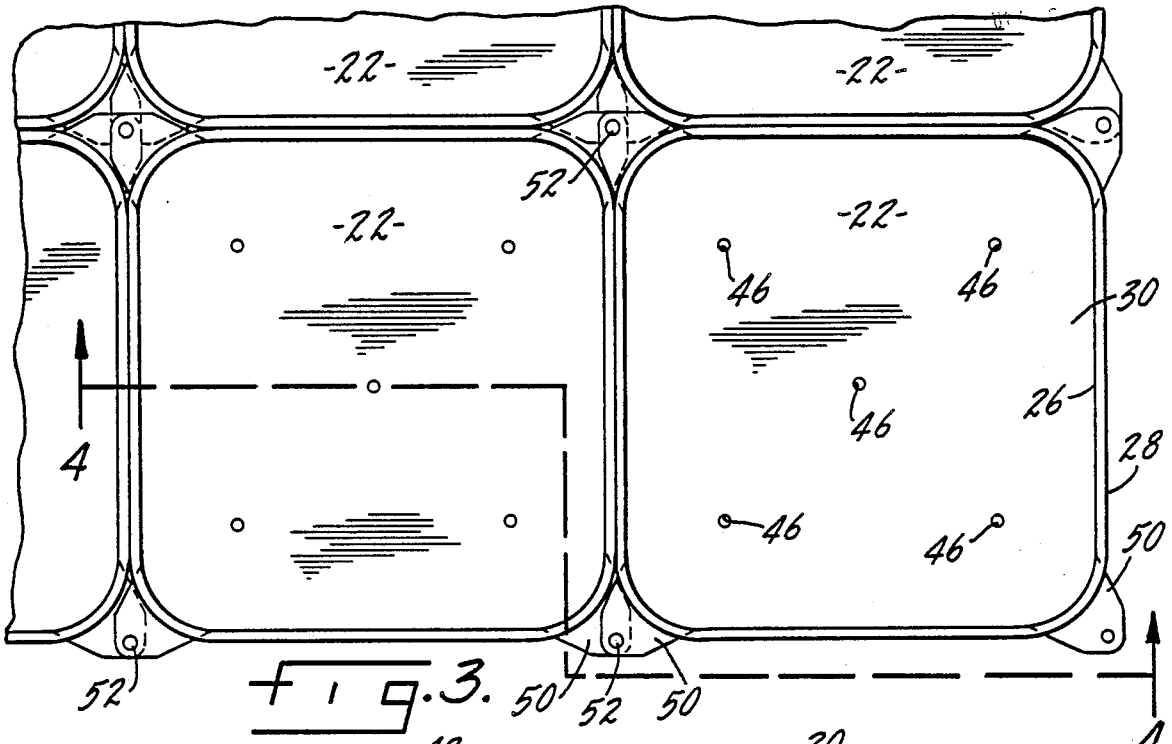
FIG. 3 is an enlarged partial top view of the baffle structure.
Figure 4:
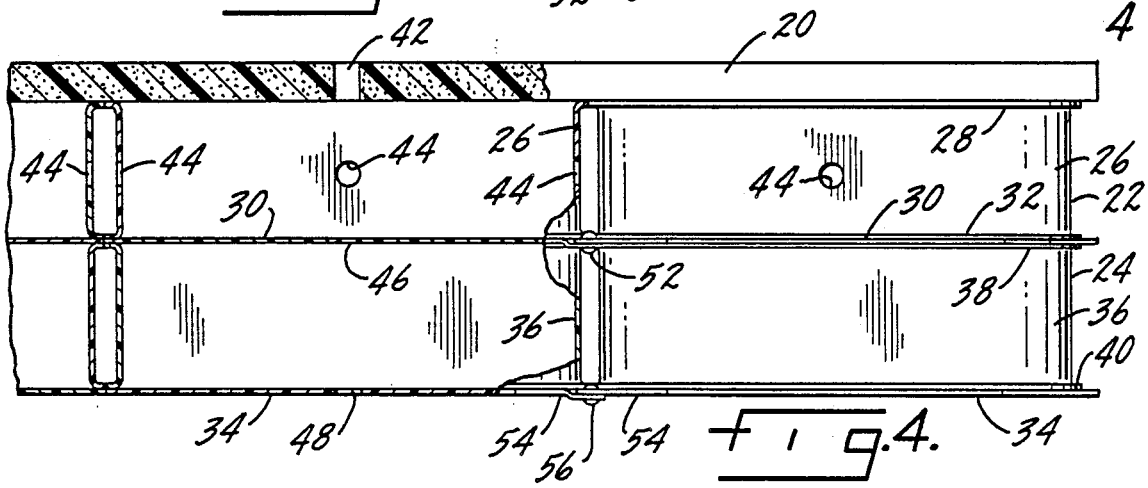
FIG. 4 is a section along plane 4—4 of FIG. 3.

Attached to the bottom of foam pad 20 are a plurality of upper cells or chambers 22 and attached at the bottom of each upper chamber 22 is a lower chamber or cell 24. FIGS. 3 and 4 illustrate the details of the vertically disposed chambers. As shown particularly in FIG. 4, each upper chamber 22 has a vertical wall 26, the upper end of which terminates in a lip 28 which extends outwardly from the wall with the lips 28 being heat sealed to the bottom of foam pad 20. As shown herein, the chambers have a generally square configuration. The invention should not be so limited. The chambers may be circular, thus having a cylindrical side wall, they may be rectangular or square, hexagonal, or of any configuration. The lower surface of each upper chamber 22 is formed by a layer of material 30 which may be of the same character and thickness as wall 26. The bottom of each wall 26 has an outwardly-extending lip 32, similar to the lips 28, with the bottom lips 32 being heat sealed to the chamber bottom 30. Thus, each upper chamber is formed by a bottom 30, a side or side walls 26, and the lower surface of foam pad 20.

Each of the lower chambers has a bottom 34 and a side or side walls 36. Sides 36 have an upper outwardly-extending lip 38 which is heat sealed to the bottom 30 and a lower outwardly-extending lip 40 which is heat sealed to the top surface of bottom 34. Thus, each lower chamber has a top, a bottom and a side or side walls. As shown herein, the configurations of the upper and lower chambers are the same, although they could be different.

In order to transfer water between the chambers and between the chambers and the body of water within the mattress, there are several openings in the baffle. Foam pad 20 has openings 42 which are in communication with the interior of upper chambers 22. By way of example, there may be one such opening for each chamber and the opening may be ½" in diameter. Each upper chamber has a plurality of side wall openings 44 and a plurality of openings 46 in bottom 30. The openings 46, which may number five, and which may for example be ¼" in diameter, are arranged with one opening at the center and the others generally equally spaced about the center opening. The bottom 34 of each lower chamber 24 may have a single opening 48 which may for example be 1" in diameter. The particular disposition, number and size of openings is not critical and should only be taken as an example of one embodiment of the invention.

The adjoining chambers are connected. Each bottom 30 has an outwardly-extending arm or tab 50 at each corner. The tabs 50 of adjoining chambers may be connected together by a fastener 52. In like manner, there are outwardly-extending tabs or arms at each corner of lower chamber bottom 34, these arms being indicated at 54, with the adjacent arms at the bottom of the baffle structure being joined together by fasteners 56. Each of the upper chambers is joined to the foam pad; each of the lower chambers is joined to an aligned upper chamber; and adjacent upper and lower chambers are joined together by the fastener and arm construction described.

It is preferred that all parts of the chamber structure be formed from a polyethylene material having a density slightly greater than that of water. This is particularly advantageous when the foam is also polyethylene, as these materials are compatible and may be reliably heat sealed together. Other plastics may be used, provided they are compatible in that they may be reliably heat sealed together to form a structure of the type described. With a baffle structure formed of polyethylene chambers having a density greater than that of water and a polyethylene foam pad having a density lower than that of water, the entire baffle structure will float within the body of water inside the waterbed outer covering.

The chamber openings provide for the dampening of wave motion brought about by a person lying or sitting upon the mattress and also retard the sinking of an individual into the mattress. When a person first sits upon the mattress over a particular chamber structure, water from within the upper chamber will be transferred to the lower chamber and will flow out of openings 42 into the area above the foam pad. Water in the upper chamber will also be transferred out of side openings 44, with the end result that the person will slowly sink into the body of water forming the mattress. Water within the lower chamber will be transferred out of the lower chamber into the body of water in the mattress. The rate at which water flows between chambers and between the area outside of the chambers and the interior of the chambers is determined by the size and number of openings.

When pressure is first applied to the upper chambers water will be transferred both to the lower chamber and outside of the baffle structure. This permits a person's body to sink into the water mattress. The lower chambers have fewer openings and thus water is transferred out of a lower chamber at a slower rate than it is transferred out of an upper chamber. This has the effect of slowing down or retarding the rate at which a person sinks within the mattress. Thus, the baffle structure described not only dampens wave motion, but controls the rate at which a person sinks into the body of water in the mattress.

Figure 5:
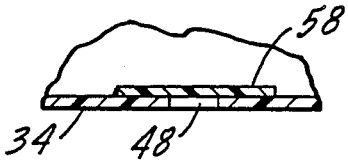
FIG. 5 is an enlarged partial side view of a portion of the bottom of a lower baffle chamber showing a modified form of the invention.

FIG. 5 shows a modification of the invention in which the openings 48 in bottoms 34 are covered by a flapper valve 58. Valve 58 will permit water to flow into the lower chambers, but not out. The result of such a structure is that only a very limited amount of water will be transferred between chambers when a person initially applies their weight to the water mattress. More water will be transferred out of the upper chambers into the area outside of the chambers and then from that area into the lower chambers. This further slows the transfer of water between chambers, as the water cannot be transferred directly, but must take a circuitous path around the baffle structure.

Although the invention has been described as including two vertically aligned chambers, it should be understood that there may be more vertically aligned chambers in a particular mattress configuration. The number of chambers is not important as long as there are at least two.

With the chamber configuration disclosed it is essentially impossible for a person to bottom out when sitting or lying on the mattress. The chamber structure prevents the transfer of all of the water beneath the weight of a person when the person's weight is initially applied. The chamber structure retards the rate at which the chambers transfer water or ventilate the area within the chambers to the area outside the chambers.

Whereas the preferred form of the invention has been shown and described herein, it should be realized that there may be many modifications, substitutions and alterations thereto.

The embodiments of the invention in which an exclusive property or privilege is claimed are defined as follows:

1. A waterbed mattress having a baffle structure comprising:

(a) a buoyant pad capable of floating freely within the mattress, (b) a plurality of chambers, an upper portion of which depend from and are attached to said buoyant pad, a lower portion of said chambers being attached to and depending from said upper chambers, openings connecting said upper and lower chambers for the passage of water therebetween when the weight of a person is placed upon the mattress, the buoyant pad and chambers having sufficient buoyancy that the baffle structure floats, and (c) a plurality of arms extending outwardly from each of said upper chambers, with the arms of one chamber being connected to the arms of adjacent upper chambers, a plurality of arms extending outwardly from each lower chamber, with the arms of adjacent lower chambers being connected to the arms of adjacent lower chambers.

2. The waterbed mattress of claim 1 further characterized in that each lower chamber has an opening connecting the interior and exterior thereof for the passage of water into and out of said lower chambers.

3. The baffle structure of claim 2 further characterized in that each lower chamber is generally vertically aligned with an upper chamber, with the bottom of each upper chamber forming the top of its corresponding lower chmaber.

4. The waterbed mattress of claim 1 further characterized in that said buoyant pad is formed of a polyethylene foam, said chambers being formed of a polyethylene material having a density greater than water.

5. The waterbed mattress of claim 1 further characterized in that each of said upper chambers is connected at the top thereof to the lower surface of said buoyant pad.

6. The waterbed mattress of claim 5 further characterized by a plurality of openings in said buoyant pad, each of said openings being in communication with an upper chamber.

7. The waterbed mattress of claim 1 further characterized in that said buoyant pad and said upper chambers are generally coextensive with the upper surface of said waterbed mattress.

* * * * *